US005332146A

United States Patent [19]

Brauner et al.

[11] Patent Number: 5,332,146

[45] Date of Patent: Jul. 26, 1994

[54] RIGHT PARALLELEPIPED PACKAGE INCLUDING NON-LINEAR FOLD LINE

[75] Inventors: Arne H. Brauner, Minnetonka; Marsha D. Thompson, Minneapolis, both of Minn.

[73] Assignee: General Mills, Inc., Minneapolis, Minn.

[21] Appl. No.: 75,423

[22] Filed: Jun. 14, 1993

[51] Int. Cl.[5] ..... B65D 5/02

[52] U.S. Cl. ..... 229/8; D9/414; D9/432; 229/922

[58] Field of Search ..... 229/132, 922, 8; D9/414, 430, 432

[56] References Cited

U.S. PATENT DOCUMENTS

| | | | |
|---|---|---|---|
| D. 183,516 | 9/1958 | Hagan | D9/432 |
| D. 183,567 | 9/1958 | Hagan | D9/432 |
| D. 183,717 | 10/1958 | Casler | D9/432 |
| D. 244,993 | 7/1977 | Drysdale | D9/432 |
| 2,050,894 | 8/1936 | Paige | 229/922 |
| 2,067,998 | 1/1937 | Williamson | 229/8 |
| 2,088,181 | 7/1937 | Swift . | |
| 2,289,859 | 7/1942 | Arthur . | |
| 2,324,232 | 7/1943 | Pantalone . | |
| 2,808,977 | 10/1957 | McCormick . | |
| 2,841,279 | 7/1958 | Forrer . | |
| 2,997,220 | 8/1961 | Williamson . | |
| 3,369,727 | 2/1968 | Wright | 229/922 |
| 3,390,827 | 7/1968 | Malby et al. | 229/8 |
| 3,610,514 | 10/1971 | Samsing | 229/8 |
| 4,166,565 | 9/1979 | Webinger | 229/8 |
| 4,313,556 | 2/1982 | Boyle et al. | 229/8 |
| 4,637,515 | 1/1987 | Wilson et al. . | |

FOREIGN PATENT DOCUMENTS

| | | | |
|---|---|---|---|
| 2305538 | 8/1973 | Fed. Rep. of Germany | 229/8 |
| 905479 | 12/1945 | France | 229/8 |

OTHER PUBLICATIONS

"Sculptured Folding Boxes" by R. E. Paige from Modern Packaging, Oct. 1940, pp. 48 & 49.

*Primary Examiner*—Gary E. Elkins

*Attorney, Agent, or Firm*—L. MeRoy Lillehaugen; John A. O'Toole; Alan D. Kamrath

[57] ABSTRACT

A collapsible, tubular carton (12) is disclosed having a non-linear fold line between the side edges (20) of the front panel (18) and the second side panel (32) which are planar in the collapsed condition of the carton (12). The fold line extends in a non-linear manner between top and bottom locations (72, 74) at the top edges (48, 68) and the bottom edges (40, 44) of the front and side panels (18, 32). In the preferred form, the fold line includes first and second, arcuate portions (82, 84) in the form of a sine curve extending from and on opposite sides of a linear line (76) extending between the top and bottom locations (72, 74). In its erect condition in the most preferred form, the carton (12) has a right parallelepiped shape, with the front and second side panels (18, 32) forming two of the sides of the parallelepiped shape. In the erect condition, the fold line between the front and second side panels (18, 32) creates a rippled corner having a tendency to attract the consumer's attention because of the difference in shape of the package (10) created thereby.

10 Claims, 2 Drawing Sheets

RIGHT PARALLELEPIPED PACKAGE INCLUDING NON-LINEAR FOLD LINE

BACKGROUND

The present invention generally relates to packages, particularly to packages formed from a blank of a single layer of material, and specifically to collapsible, tubular packages including nonlinear fold lines.

In the marketing of many types of products such as breakfast cereals, the packaging itself plays an important part in the product merchandising. In addition to the printed material appearing thereon, the shape of the package can play a major role in attracting the attention of the consumer towards the product and hopefully resulting in the purchase thereof. Specifically, most products are marketed in packages of rectangular parallelepiped shapes. Thus, packages having shapes different from standard rectangular parallelepiped shapes will have a tendency to attract the consumer's attention. However, it is desired to have the non-standard shaped packages be able to be displayed in the same areas as packages of standard shapes would be displayed in both their ability to be stacked in columns and rows in the display area as well as their ability to be stacked vertically in the display area.

One type of non-standard shaped packages are packages of other than rectangular parallelepiped shapes. For example, one type of package of non-standard shape that has gained some market acceptance are those including a gable-shaped top such as those shown in U.S. Pat. No. 5,230,463. Although packages including gable-shaped tops generally can be displayed in the same areas as packages of standard designs would be displayed, additional effort is required in the production and distribution of gable-shaped top packages. Another example of packages of non-standard shape are packages of other than parallelepiped shapes. However, as special handling and equipment are required for these types of packaging, market acceptance of such packages has been limited. To take advantage of the uniqueness of packages of non-parallelepiped shapes but to reduce the problems associated therewith, the liquor industry for Christmas gift packaging has utilized cartons having square tops and bottoms but including five face panels formed by first and second diverging fold lines at one of the corners which created the fifth, football-shaped, panel.

Thus, a need exists for a package of a non-standard shape tending to attract the consumer's attention and which is formed from a blank of a single layer of material in a collapsible, tubular configuration which is acceptable to production, distribution, and marketing generally without extra effort and/or expense.

SUMMARY

Surprisingly, the above need and other problems in the field of packages of non-standard shapes have been solved by providing, in the preferred form, a tubular carton having a fold line between first and second panels which are planar in the collapsed condition, with the fold line extending in a non-linear manner between the top and bottom edges of the first and second panels. In a first aspect of the present invention, the first and second panels extend generally perpendicularly in the erect condition and form two of the sides of a parallelepiped shape. In another aspect of the present invention, the fold line includes first and second, arcuate portions extending from and on opposite sides of a linear line between the termination locations of the fold line at the top and bottom edges of the panels.

These and further aspects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
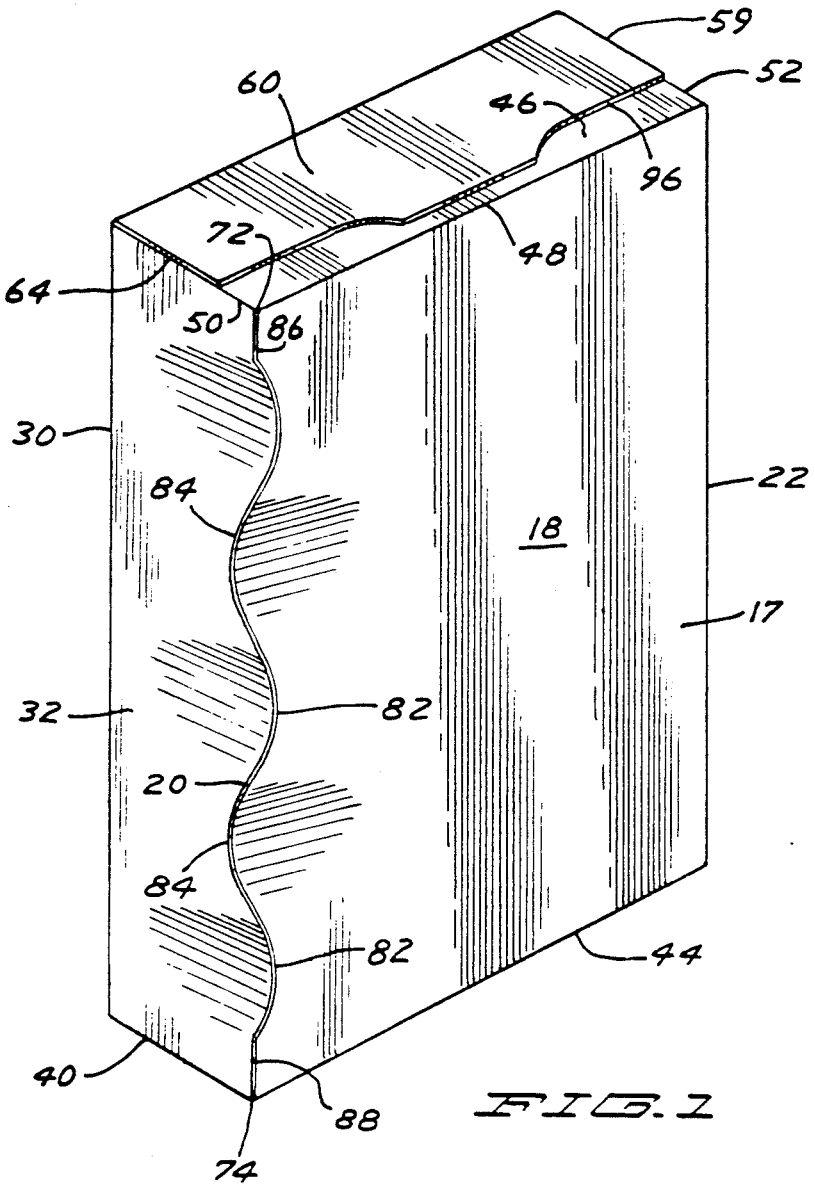
FIG. 1 shows a perspective view of a package including a non-linear fold line according to the preferred teachings of the present invention.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "edge", "side", "front", "back", "length", "width", "inner", "outer", and similar terms are used herein, it should be understood that these terms have reference only to the structure shown in the drawings as it would appear to a person viewing the drawings and are utilized only to facilitate describing the invention.

DESCRIPTION

A package according to the preferred teachings of the present invention is shown in the drawings and generally designated 10. Generally, package 10 includes an outer carton 12 and an inner liner, not shown. The inner liner can be formed of any suitable material, such as glassine, wax paper, or plastic, and can be formed in any suitable manner as is well known in the art.

Carton 12 according to the teachings of the present invention is formed from a blank 16 of a single layer of generally stiff material such as paperboard. Blank 16 includes an outer surface 17 which has printed material and an inner surface 19 which is plain and does not include printed material. Blank 16 generally includes a rectangular, front panel 18 having a side edge 20 and a second, parallel side edge 22 which is continuously integrally connected to the side edge 22 of a first, rectangular side panel 24 about a fold line. The opposite, parallel side edge 25 of side panel 24 is free. Blank 16 further includes a rectangular back panel 28 having a side edge 26 and a second, parallel side edge 30 continuously integrally connected to the side edge 30 of a second, rectangular side panel 32 about a fold line. The opposite, parallel side edge 20 of side panel 32 is continuously integrally connected to the side edge 20 of front panel 18 about a fold line. The side edge 26 of a glue flap 36 is continuously integrally connected to side edge 26 of back panel 28 about a fold line. Glue flap 36 in the most preferred form has the shape of an isosceles trapezoid with the major base extending along edge 26. Outer surface 17 of flap 36 can be secured to inner surface 19 of side panel 24 by any suitable means such as glue with edges 25 and 26 being coextensive with the glue flap 36 secured, edge 25 of panel 24 is continuously integrally connected to edge 26 of panel 28 about the fold line between panel 28 and glue flap 36. Panels 18, 24, 28, and 32 have equal heights, with panels 18 and 28 having equal widths which are substantially larger and particularly a multiple of the widths of panels 24 and 32 and specifically which are 2.9 times the widths of panels 24 and 32. In the preferred form, side panels 24 and 32 have equal widths and extend generally perpendicularly between panels 18 and 28 in the most preferred form to form a hollow rectangular parallelepiped.

The bottom of carton 12 can be formed by any suitable manner and is flat. In the preferred form, side panels 24 and 32 include rectangular dust flaps 38 integrally extending from their bottom edges 40 about fold lines and having widths which are identical to side panels 24 and 32, with bottom edges 40 extending perpendicularly between edges 22 and 25 of panel 24 and between edges 20 and 30 of panel 32. Front and back panels 18 and 28 each include generally rectangular closure flaps 42 integrally extending from their bottom edges 44 about fold lines and having widths which are identical to panels 18 and 28, with bottom edges 44 extending perpendicularly between edges 20 and 22 of panel 18 and between edges 26 and 30 of panel 28. The lengths of flaps 38 and 42 from bottom edges 40 and 44 to their respective free edges are at least equal to one-half of the widths of side panels 24 and 32 and of flaps 38 but less than the widths of panels 18, 24, 28, and 32, with the lengths of flaps 38 from bottom edges 40 to their free edges being less than the lengths of flaps 42 from bottom edges 44 to their free edges in the most preferred form. The side edges of flaps 38 and 42 are separated from each other. The bottom of carton 12 can then be formed by folding dust flaps 38 inwardly and generally perpendicular to side panels 24 and 32. Then one of the closure flaps 42 can be folded such that inner surface 19 thereof overlies at least portions of outer surfaces 17 of flaps 38. Thereafter, the other closure flap 42 can be folded such that inner surface 19 thereof overlies outer surfaces 17 of flaps 38 and possibly of portions of the first closure flap 42. The outer surfaces 17 of the inner flaps 38 and/or 42 can be secured to the inner surfaces 19 of the outer flap 42 by any suitable means such as glue.

The top of carton 12 according to the teachings of the present invention can be formed by any suitable manner and is flat. In the most preferred form of a reclosable variety, blank 16 generally includes a rectangular front top panel 46 having a free top edge 47 and a parallel, bottom edge 48 integrally connected to the top edge 48 of front panel 18 about a fold line, with edge 48 extending perpendicularly between edges 20 and 22 of panel 18. Panel 46 includes a first, free side edge 50 and an opposite, parallel, free side edge 52. Blank 16 further includes a first, rectangular, side top panel 54 having a free top edge 78 and a bottom edge 56 integrally connected to the top edge 56 of side panel 24 about a fold line, with edge 56 extending perpendicularly between edges 22 and 25 of panel 24. Panel 54 includes a first, free side edge 53 adjacent and parallel to side edge 52 of panel 46 and an opposite, generally parallel, free side edge 58. Blank 16 further includes a generally rectangular back top panel 60 having a free top edge 96 and a bottom edge 62 integrally connected to the top edge 62 of back panel 28 about a fold line, with edge 62 extending perpendicularly between edges 26 and 30 of panel 28. Panel 60 includes a first, free side edge 59 and an opposite, parallel, free side edge 64. Blank 16 further includes a second, rectangular side top panel 66 having a free top edge 80 and a bottom edge 68 integrally connected to the top edge 68 of side panel 32 about a fold line, with edge 68 extending perpendicularly between edges 20 and 30 of panel 32. Panel 66 includes a first, free side edge 65 adjacent and parallel to edge 64 of panel 60 and an opposite, parallel, free side edge 70 adjacent and parallel to edge 50 of panel 46.

The top of carton 12 can then be formed by folding top panels 54 and 66 inwardly and generally perpendicular to side panels 24 and 32. Then panel 46 can be folded such that inner surface 19 thereof overlies at least portions of outer surfaces 17 of panels 54 and 66. Thereafter, panel 60 can be folded such that inner surface 19 thereof overlies outer surfaces 17 of panels 54 and 66 and of portions of panel 46. Panel 60 can be secured to panel 46 by any suitable means. For example, at the factory, the top of carton 12 can be secured by glue located on outer surface 17 of panel 46 abutted by inner surface 19 of panel 60, with the glue securement being releasable by the consumer to open the top of carton 12. To removably secure panel 60 to panel 46, free edge 96 of panel 60 includes a contiguous tab 106 extending therefrom which can be slideably received in a U-shaped die cut 110 formed in panel 46 spaced inwardly of free edge 47 and side edges 50 and 52 of top panel 46 complementary and corresponding to tab 106. To open carton 12 for access to the interior thereof and the product located therein, the securement of panel 60 to panel 46 is removed, panels 46, 54, 60, and 66 are then folded to extend generally linearly from panels 18, 24, 28, and 32, respectively. Alternately, panels 46, 54, 60, and 66 can be pivoted about their respective fold lines such that inner surfaces 19 thereof extend at an obtuse angle typically no larger than 270° to inner surfaces 19 of panels 18, 24, 28, and 32. It should be noted that the fold lines between edges 20, 22, 26, 30, 40, 44, 48, 56, 62, and 68 in the most preferred form shown are formed by scoring blank 16 and particularly by linearly indenting outer surface 17 creating a concave channel depression therein and creating a convex linear projection in inner surface 19. It can be appreciated that fold lines can be formed in other manners such as by perforating blank 16 to a depth equal to or less than the thickness thereof, with the spacing between the perforations maintaining the continuous connection between panels 18, 24, 28, and 32.

As previously set forth, the top of carton 12 can be formed by other manners such as of the single service type. Specifically, when the contents of a package 10 are removed in their entirety at the time of opening such as a single serving of food ingredients, the top of carton 12 can include a tear-type strip which is torn by the consumer to open carton 12 but which typically does not allow securement thereafter.

Figure 3:
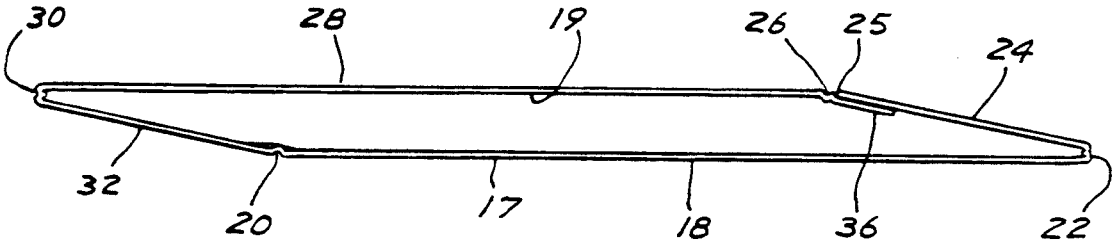
FIG. 3 shows a cross-sectional view of the package of FIG. 1 generally in its collapsed or folded condition, with the package being slightly open for ease of illustration.
Figure 2:
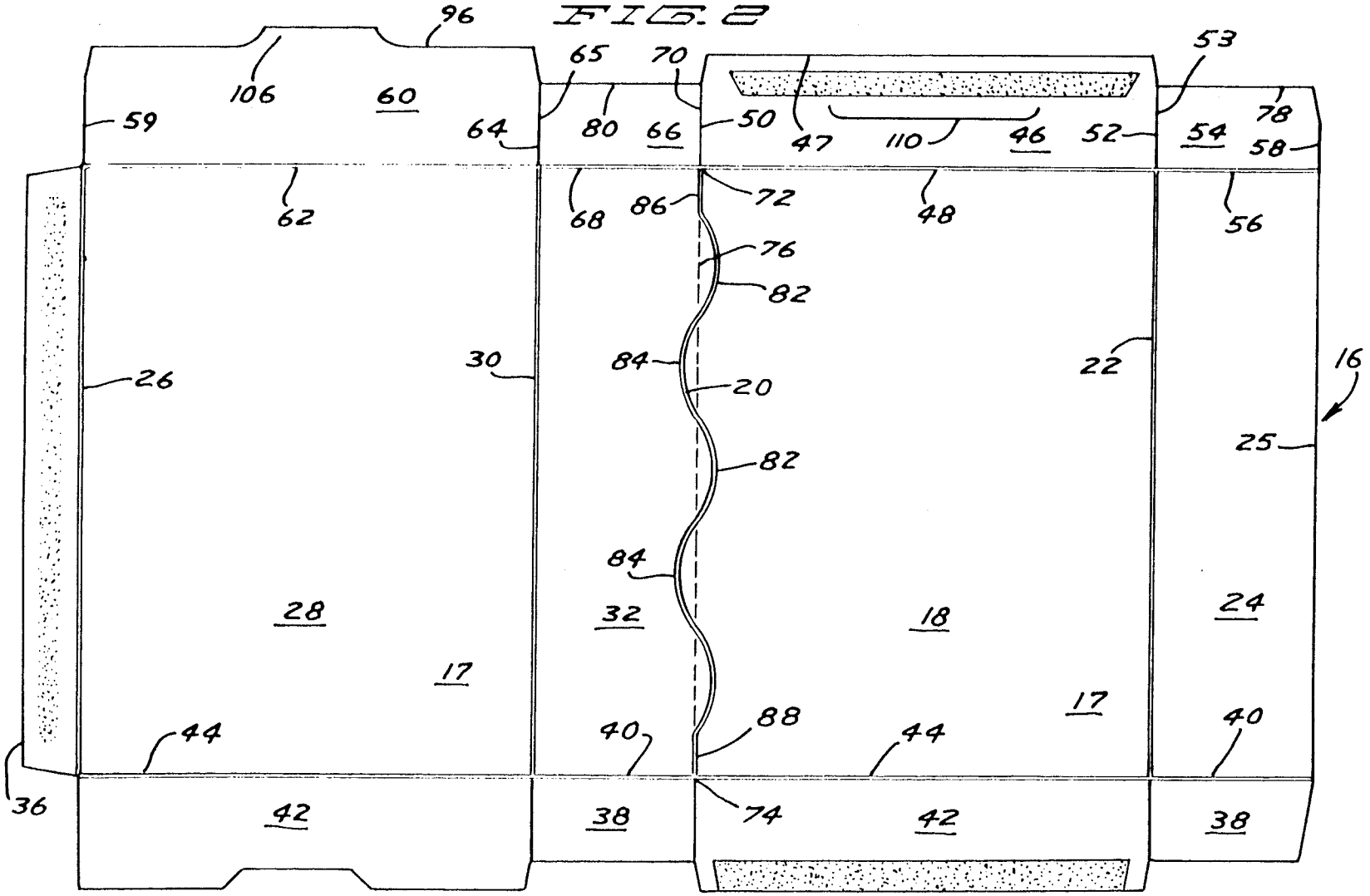
FIG. 2 shows a top plan view of a blank that may be folded into the carton of the package of FIG. 1.

Cartons 12 are typically stored in a collapsed tubular state shown in FIG. 3 before forming into package 10. Particularly, with the outer surface 17 of glue flap 36 secured to inner surface 19 of panel 24 and in the collapsed, tubular state, panels 18 and 32 and panels 24 and 28 are generally planar, with the angles between edges 20 and edges 25 and 26 being 180° and the angles between edges 22 and 30 being 360°. Panels 18 and 32 underlie panels 24 and 28 with panels 24 and 28 overlying panel 18 and panel 28 overlying panels 32 and 18. To erect carton 12 from its collapsed state into a generally rectangular parallelepiped shape, edges 20, 22, 25, 26, and 30 are pivoted relative to each other, with panels 18 and 28 extending generally perpendicular to panels 24 and 32.

It can then be appreciated that the bottom of carton 12 formed by the securement of outer flap 42 to inner flaps 38 and 42 closes and holds bottom edges 40 and 44 of panels 18, 24, 28, and 32, in the most preferred form, in a rectangular configuration. Thus, the formed bottom of carton 12 holds carton 12 in the generally rectangular parallelepiped shape. Likewise, the top of carton 12 formed by securement of flap 46 to flap 60 closes and holds top edges 48, 56, 62, and 68 of panels 18, 24, 28, and 32, in the most preferred form, in a rectangular configuration. Thus, the formed top of carton 12 also holds carton 12 in the generally rectangular parallelepiped shape. The formed top of carton 12 can be opened such as by removing the securement of panel 60 to panel 46, and panels 48, 54, 60, and 66 are pivoted about their respective fold lines from a closed position extending generally perpendicular to panels 18, 24, 28, and 32, respectively, to an open position extending other than at an angle of 90° to panels 18, 24, 28, and 32 and usually extending at an obtuse angle typically no larger than 270° thereto.

Carton 12 as described thus far is of a conventional construction and does not form part of the present invention. It should be appreciated that carton 12 can have a variety of different types of construction other than as shown and described according to the teachings of the present invention.

Carton 12 according to the teachings of the present invention includes a non-linear fold line between panels 18 and 32. In the most preferred form, the fold line between panels 18 and 32 extends between top edges 48 and 68 and bottom edges 40 and 44 in a non-linear manner, with the fold line and side edges 20 terminating at a top location 72 at top edges 48 and 68 and at a bottom location 74 at bottom edges 40 and 44, with the fold line and side edges 20 extending along a linear line 76 between locations 72 and 74 in a standard rectangular parallelepiped shaped package, not shown. Particularly, edges 20 include multiple first portions 82 which extend arcuately from linear line 76 onto front panel 18. Edges 20 further include multiple second portions 84 extending arcuately from linear line 76 onto side panel 32. In the preferred form, portions 84 are located intermediate portions 82 and are contiguous therewith, and in the most preferred form portions 82 and 84 are in the form of a sine curve. Edges 20 further include third and fourth portions 86 and 88 which are linear and lying along linear line 76, with portions 82 and 84 located between portions 86 and 88. In the most preferred form, portion 86 extends from location 72 towards but spaced from location 74 and portion 88 extends from location 74 towards but spaced from location 72, with portions 82 and 84 being non-linear between portions 86 and 88.

It can then be appreciated that in the collapsed condition, carton 12 has generally the same handling and storage characteristics of a carton 12 of a standard configuration from the supplier of carton 12 to the filling location of carton 12. Particularly, as panels 18 and 32 are in a planar condition in the collapsed condition, side edges 20 are in the same-plane as panels 18 and 32 and create a serpentine score line therein. However, when opened to its erect condition, the non-linear nature of side edges 20 forming the fold line between panels 18 and 32 creates a rippled corner between panels 18 and 32 due to the interconnection of edge 20 of panel 32 along portion 84 and due to the interconnection of edge 20 of panel 18 along portion 82. In its erect condition, carton 12 maintains its four distinct sides in the shape of a right parallelepiped and particularly with panels 18 and 32 extending generally perpendicularly at any point along side edges 20 between locations 72 and 74. This rippled corner of carton 10 according to the teachings of the present invention has a tendency to attract the consumer's attention because of the difference from standard rectangular parallelepiped shaped packages. This tendency can be further enhanced by the printed material on outer surface 17. For example, portions 84 and/or the printed material can be customized to give the most drama at the retail shelf such as by having one of portions 84 cradle the letter "C" or other arcuately shaped letter which is the initial letter of a product name or trademark appearing in the printed material on outer surface 17 of panel 18. Similarly, portions 84 could be in registration with graphic components of the printed material along side edge 20 of panel 18. Additionally, the rippled corner of carton 10 according to the teachings of the present invention can physically communicate the "rippled" nature of a product, such as rippled food products being merchandized in package 10, and act as a trademark in helping the consumer identify the product and source, thus attracting the consumer's attention thereto. The tendency of attracting the consumer's attention towards the product can play a major role in the consumer's ultimate decision of purchasing the product.

It should be noted that since carton 12 according to the teachings of the present invention generally maintains the right parallelepiped shape in its erect condition, production, distribution, and marketing of package 10 can be carried out with little or no modification from the production, distribution, and marketing of packages of standard rectangular parallelepiped shapes. Thus, the enhanced marketability of package 10 can be obtained according to the teachings of the present invention without extra effort and expense in production, distribution, and marketing.

It can be appreciated that the fold line between panels 18 and 32 can have other nonlinear forms according to the teachings of the present invention than as shown and described. For example, although portions 82 and 84 are of the same size in the most preferred form, portions 82 and 84 could be of different sizes. Likewise, one of portions 82 or 84 could be eliminated with the fold line extending only in one direction from linear line 76 at one or more locations and in a contiguous manner or a spaced manner. Likewise, portions 82 and/or 84 could be of differing sizes from location 72 to location 74. Further, if desired, the fold line between panels 24 and 28 which are also planar in the collapsed condition can extend in a nonlinear manner between bottom and top edges 40, 44, 48, and 62 to further enhance the unconventional shape of package 10 according to the teachings of the present invention.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Tubular carton movable between a collapsed condition and an erect condition in the shape of a parallelepiped, comprising, in combination: a front panel having first and second side edges; a first side panel having first and second side edges, with the second side edge of the front panel and the first side panel abutting at all points and being integrally connected together about a fold line, with the front panel overlying the first side panel in the collapsed condition; a back panel having first and second side edges, with the first side edges of the back panel and the first side panel abutting at all points and being integrally connected together about a fold line, with the back panel and the first side panel being planar in the collapsed condition; a second side panel having first and second side edges, with the second side edges of the back panel and the second side panel abutting at all points and being integrally connected together about a fold line, with the back panel underlying the second side panel in the collapsed condition, with the first side edges of the front panel and the second side panel abutting at all points and being continuously integrally connected together about a fold line, with the front and second side panels being planar in the collapsed condition, with at least the front panel and the second side panel having top and bottom edges, with the fold line between the front and second side panels extending in a non-linear manner between the top and bottom edges of the front panel and the second side panel, with the side panels extending generally perpendicular between the front and back panels in the erect condition.

2. The tubular carton of claim 1 wherein the fold line between the front and second side panels terminates at top and bottom locations at the top and bottom edges of the front and second side panels, with the fold line between the front and second side panels having at least a first portion extending arcuately from a linear liner between the top and bottom locations onto the second side panel.

3. The tubular carton of claim 14 wherein the fold line between the front and second side panels has a second portion extending arcuately from the linear line between the top and bottom locations onto one of the front and second side panels.

4. The tubular carton of claim 3 wherein the second portion extends onto the front panel.

5. The tubular carton of claim 3 wherein the first, arcuate portion is sequentially contiguous with the second, arcuate portion.

6. The tubular carton of claim 5 wherein the first and second, arcuate portions are in the form of a sine curve.

7. The tubular carton of claim 3 wherein the fold line between the front and second side panels has at least a third portion which is linear.

8. The tubular carton of claim 7 wherein the fold line between the front and second side panels has a fourth portion which is linear, with the fourth, linear portion extending from the bottom location towards but spaced from the top location, with the third, linear portion extending from the top location towards but spaced from the bottom location, with the fold line between the front and second side panels being non-linear between the third and fourth, linear portions.

9. The tubular carton of claim 7 wherein the fold line between the front and second side panels has a fourth portion which is linear, with the first and second, arcuate portions located between the third and fourth, linear portions.

10. The tubular carton of claim 8 wherein the fold line between the front and second side panels is in the form of a sine curve between the third and fourth, linear portions.

* * * * *

UNITED STATES PATENT AND TRADEMARK OFFICE

CERTIFICATE OF CORRECTION

PATENT NO. : 5,332,146

DATED : July 26, 1994

INVENTOR(S) : Arne H. Brauner & Marsha D. Thompson

It is certified that error appears in the above-identified patent and that said Letters Patent is hereby corrected as shown below:

Col. 6, line 4; "same-plane" should be -- same plane --;

Col. 8, line 6; "liner" should be -- line --;

Col. 8, line 9; "14" should be -- 2 --.

Signed and Sealed this

First Day of November, 1994

Bruce Lehman

*Attest:*

BRUCE LEHMAN

*Attesting Officer*

*Commissioner of Patents and Trademarks*